US009352205B2

(12) United States Patent
Pemberton

(10) Patent No.: US 9,352,205 B2
(45) Date of Patent: May 31, 2016

(54) SWIM INSTRUCTION MIRROR AND RELATED METHOD

(76) Inventor: Charles Edward Pemberton, Knoxville, TN (US)

( * ) Notice: Subject to any disclaimer, the term of this patent is extended or adjusted under 35 U.S.C. 154(b) by 510 days.

(21) Appl. No.: 11/700,301

(22) Filed: Jan. 31, 2007

(65) Prior Publication Data

US 2008/0299528 A1 Dec. 4, 2008

(51) Int. Cl.
*A63B 69/12* (2006.01)
*G02B 7/182* (2006.01)

(52) U.S. Cl.
CPC ..... *A63B 69/12* (2013.01); *A63B 2225/055* (2013.01); *A63B 2225/12* (2013.01)

(58) Field of Classification Search
CPC ..... A63B 69/12; G02B 7/182
USPC ..... 434/254
See application file for complete search history.

(56) References Cited

U.S. PATENT DOCUMENTS

| | | | | | |
|---|---|---|---|---|---|
| 2,091,203 | A * | 8/1937 | Vidal Hay | 248/467 |
| 2,875,528 | A * | 3/1959 | Garate | 434/254 |
| 2,956,541 | A * | 10/1960 | Rall | 434/254 |
| 2,968,995 | A * | 1/1961 | Holden | 248/467 |
| 3,140,550 | A * | 7/1964 | Wayfield | 434/254 |
| 4,067,535 | A * | 1/1978 | Rose | 248/470 |
| 4,693,570 | A * | 9/1987 | Kryder | 359/855 |
| 4,856,888 | A * | 8/1989 | Wahl | 359/881 |
| D336,721 | S * | 6/1993 | Froidevaux | D6/300 |
| 5,566,031 | A * | 10/1996 | Meyr et al. | 359/883 |
| 2006/0014448 | A1 * | 1/2006 | Severino | 441/55 |

* cited by examiner

*Primary Examiner* — Timothy Musselman
*Assistant Examiner* — Alvin Carlos
(74) *Attorney, Agent, or Firm* — R. Christian Macke

(57) ABSTRACT

A method and apparatus for swim training utilizing mirrors. Waterproof, shatterproof mirrors are used to assist in getting children acclimated to a swimming pool, and to provide an instructional amusement for beginning swimmers learning to go underwater. A mirror with a handle is provided allowing an instructor to hold the mirror with one hand while holding an infant with the other to allow the infant to see itself while in the water. The handle also attaches to the side or bottom of a swimming pool, allowing the mirror to be mounted underwater to amuse swimmers to see themselves when they go underwater. A method utilizes the hand held mirror to alternatively let an infant see himself while in the water, or be used as a motivational amusement device for novice swimmers, by mounting it underwater, allowing the swimmers to see themselves when they go underwater.

15 Claims, 3 Drawing Sheets

SWIM INSTRUCTION MIRROR AND RELATED METHOD

FIELD OF THE INVENTION

This invention relates to a method and device relating swim instruction of infants and small children, particularly relating to the use of a hand held mirror.

BACKGROUND OF THE INVENTION

Swimming is a common past-time practiced by a large segment of the population. It is also an important survival skill that is taught and learned by many persons as a small child. In addition, competitive swimming is an internationally competitive sport featured prominently as an Olympic sport and in scholastic and intercollegiate athletics. As such, the methods and devices used in the instruction of swimming have wide appeal.

Swim instruction is provided at many different levels and for many different reasons, from taking an infant and acclimating it to the water to teaching basic water safety to small children, all the way up to perfecting strokes of skilled experienced swimmers competing at the highest levels. The need for an innovative mirror that can be used in and around water at various stages of swim instruction is identified.

Small children, particularly infants, have been demonstrated to be more secure and readily acclimated to the water if they are able to see a familiar face when being introduced to the water, including their own reflection. A child or infant seeing his own face, reflected in a nearby mirror, is more comfortable and receptive to swim instruction. Thus there is identified a need for a mirror that can be positioned to provide a child's reflection, which is also safe and easily maintained around pools, particularly a mirror that is shatterproof, waterproof, impervious to chlorine and scratch and scuff resistant.

As children get older and move from infants to toddlers and beyond, swim instruction and learning remains important, although different skills are being taught and refined as the child ages. For example, a child's ability to go underwater and remain underwater, and to swim down to a certain depth, becomes an important building block in the instruction of swimming. Incentives to motivate children to go underwater and to swim down are well known, such as sink toys that go to the bottom of a pool and must be retrieved. It has also been found that a mirror placed underwater, that allows children to see themselves while underwater, is popular as a motivational tool to get them to go underwater. There is thus identified a need for a mirror that can be positioned underwater and which is safe and easily maintained around pools, particularly a mirror that is shatterproof, waterproof, impervious to chlorine and scratch and scuff resistant.

A wide array of training devices are well known for competitive swimmers that allow them to see, analyze and modify their stroke while in the water. Examples of such training devices include tanks and devices that hold a swimmer stationary either by mechanical means or by creating a current against which the swimmer swims.

A vast number of prior art devices and methods have been utilized in the instruction of swimming, including kickboards such as those disclosed in U.S. Pat. Nos. 4,518,364; 6,955,577; 6,840,831; and 5,518,429. In addition, devices and methods for holding a swimmer afloat or stationary in the water so that swimming strokes can be safely practiced and perfected are well known, such as those disclosed in U.S. Pat. Nos. 644,593; 1,238,380; 5,236,404; 5,391,080; 5,813,945; 6,905,444; 6,960,086; and 6,347,971.

In addition, other prior art devices have disclosed the use of mirrors in water to allow competitive swimmers to observe their strokes while in water, such as U.S. Pat. Nos. 4,693,570 and 2,875,528. In both of those patents, the mirrors utilized underwater were large and permanently mounted underwater and intended to give the swimmer a full view of his arms and legs while underwater. Those mirrors were not capable of being hand held, or of being detached from the pool wall or bottom to which they were affixed.

To improve the method and devices for swim instruction, there is thus provided a need for a shatterproof, scratch resistant, waterproof and chlorine resistant mirror that can be easily held by a swim instructor with one hand while holding an infant or small child with the other hand. By holding the mirror above the child while entering the water, such that the child can see himself, the instructor improves the acclimation of the child to the water. The mirror is also capable of being used by an instructor in later stages of swim instruction by attaching it to the sides or bottom of a pool to provide an amusing incentive for children to go underwater and to swim down to a depth such that they can see themselves.

There is thus identified a need for a mirror that is safe around water in that it is shatterproof and waterproof. Also, the mirror should be scratch and scuff resistant and should be non-reactive with chlorine for long life around pools. Providing a mirror that has a convenient and accessible handle allows its use as an infant comforting mirror by allowing an instructor to hold the mirror with one hand while holding the infant with the other. Further, a means for attaching the mirror to the wall or bottom of a pool would be similarly advantageous.

OBJECTS OF THE INVENTION

It is an object of the present invention to provide a hand held mirror to be used in swim instruction of infants, toddlers and small children.

It is another object of the present invention to provide a hand held mirror that can be easily handled, manipulated, oriented and positioned by an instructor using one hand while holding the infant, toddler or small child with the other hand so that they can see themselves.

It is yet another object of the present invention to provide a hand held mirror having a means for attachment to the walls, sides or bottom of a swimming pool to provide small children an incentive to go underwater to see themselves in the mirror.

It is a further object of the present invention to provide a mirror that is shatterproof and safe for use in and around pools.

It is a further object of the present invention to provide a swim mirror having a handle and attachment device comprising the same structural elements.

It is yet another object of the present invention to provide a method for teaching infants, toddlers and small children to swim incorporating the use of hand held mirrors to assist in the acclimation of infants, toddlers and small children to the water.

It is a further object of the present invention to provide a method for swim instruction comprising the use of mirrors mounted underwater that provide incentive and motivation for small children to go underwater to see their reflections in the mirrors.

It is another object of the present invention to provide a multiple step method of swim instruction for infants, toddlers and small children utilizing shatterproof, waterproof mirrors that are hand held in an initial phase to help get the infants acclimated to the water and, in a subsequent phase, are mounted underwater in a swimming pool to provide an amusing incentive for small children to go underwater to see themselves.

These and other objects and advantages of the present invention will be apparent from a review of the following specification and accompanying drawings.

SUMMARY OF THE INVENTION

The present invention provides a multiple layer, handheld mirror used in swim instruction having a layer of transparent material and a layer of reflective material affixed to the layer of transparent material. A means for holding the handheld mirror with one hand is provided by a handle affixed to the layer of reflective material opposite the layer of transparent material. The swim mirror, and all of its elements, are safe for use in and around water, most notably by being shatterproof. The handheld mirror is also waterproof, and the layer of transparent material and the layer of reflective material are scratch resistant. In addition, the mirror and all of its elements are non-reactive with chlorine, so that the mirrors do not deteriorate when subjected to chlorinated water of a swimming pool.

The handheld mirror of the present invention includes a handle that is easily engaged with one hand allowing manipulation and changes to orientation and position of the mirror with one hand. A fixation means is provided that allows attachment of the mirror to the sides and bottom of a swimming pool, fixation means further comprising a first flange permanently affixed to the handheld mirror and a second flange removably affixed to the sides or bottom of a swimming pool. In the most preferred embodiment of the present invention, the second flange comprises a suction cup with a transitional stem for connecting the suction cup to the first flange. The transitional stem defines a gap between the first flange and suction cup, the gap being sufficiently broad for a typical adult hand to be positioned therein, although the cross section of the stem is sufficiently narrow to allow typical adult fingers to engage said stem.

Also disclosed in the present invention is a method for teaching a small child to swim comprising the steps of providing a mirror having a reflective surface that is easily picked up, held and manipulated with one hand, followed by picking up and holding the small child with the hand not holding the mirror during an initial phase of instruction, while holding the mirror with the second hand during the initial phase of instruction. The instructor then uses the mirror by holding, manipulating and orienting the reflective surface such that the small child can see itself in the reflective surface as it is being introduced to the water.

The method utilizing the mirror utilizes a handheld mirror that is safe for use near a pool and that further comprises a handle easily engaged by one hand. The mirror used in the inventive swim instruction method is also waterproof and non-reactive with chlorine, and includes means for mounting the reflective surface underwater to a side or bottom of a swimming pool, and the inventive swim instruction method includes mounting the reflective surface underwater to a side or bottom of a swimming pool and using the reflective surface mounted underwater as an amusement for small children to encourage small children to go underwater to see themselves.

In a significant feature of the present invention, the mirror used in the swim instruction method has a handle and a mounting means comprising the same structural element, specifically wherein the handle and the mounting means comprise a first flange permanently affixed to a back side of the non-reflective surface and a second flange comprises a handle affixed to the first flange.

Another method for swim instruction for teaching a small child to swim is disclosed which comprises the steps of providing a reflective surface having a means for removably being mounted underwater to a side or bottom of a swimming pool. The reflective surface is then mounted to a side or bottom of a swimming pool and, using the reflective surface mounted underwater as an amusement for small children learning to swim, the small children are encouraged to go underwater to see their reflections in the mirror.

DETAILED DESCRIPTION OF THE INVENTION

Figure 1:
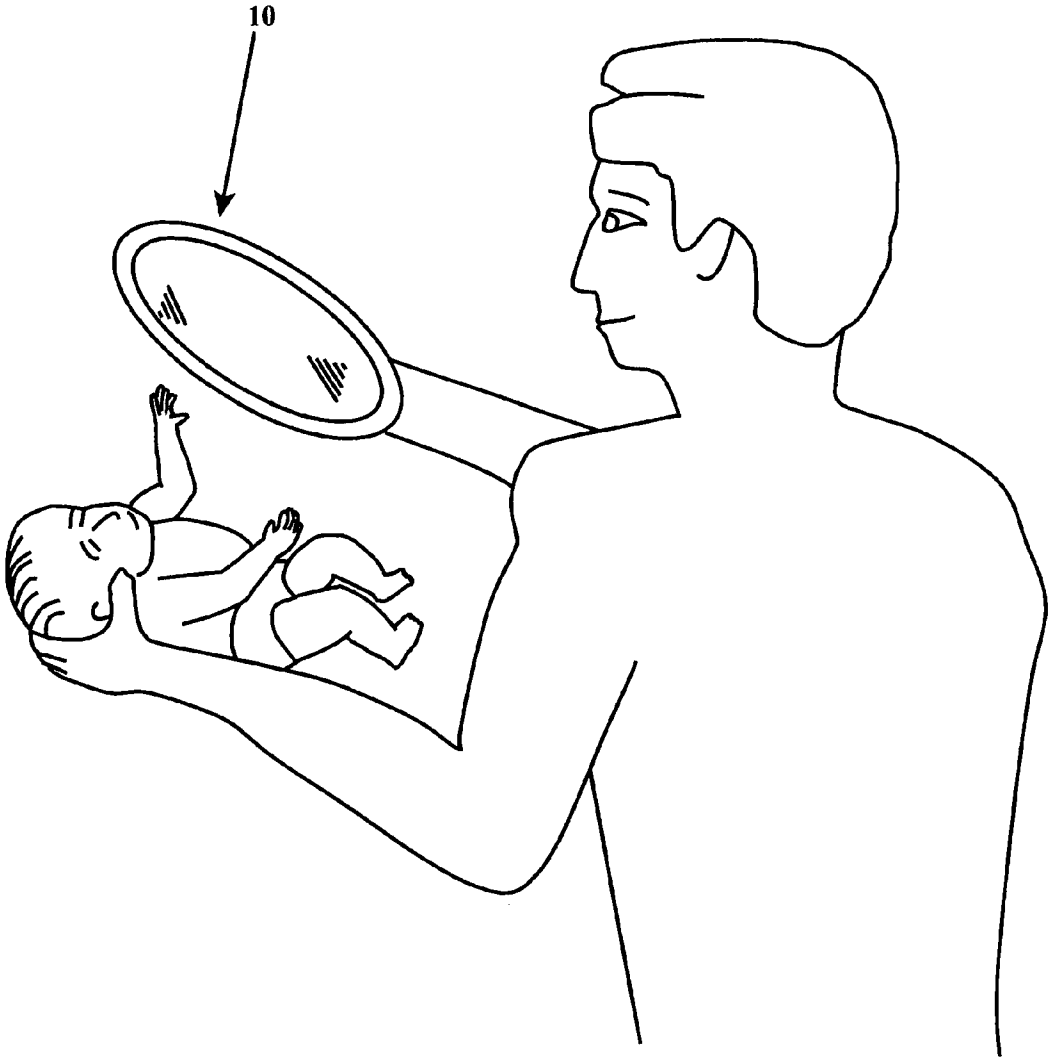
FIG. 1 is a perspective view showing the use of the hand held mirror being held by an instructor in one hand while holding a small infant in the other hand.
Figure 3:
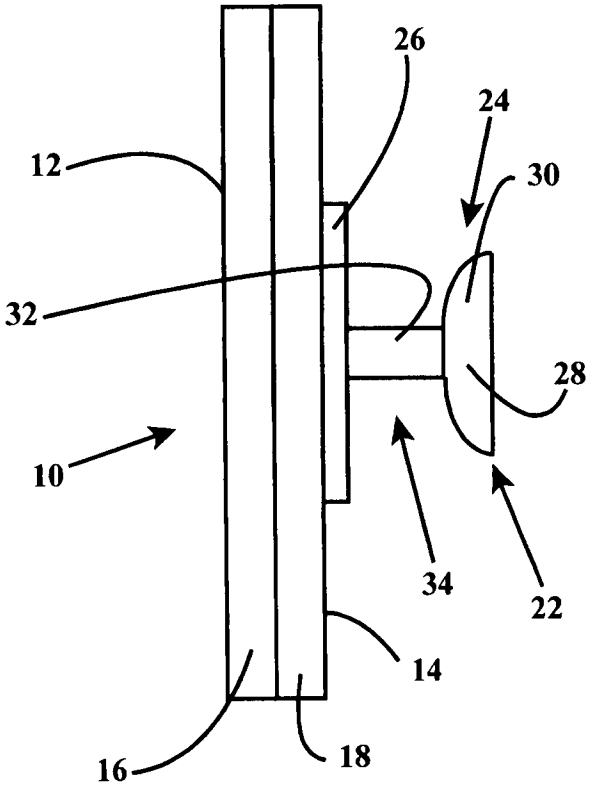
FIG. 3 is a side view of the mirror having a handle and suction cup assembly.
Figure 2:
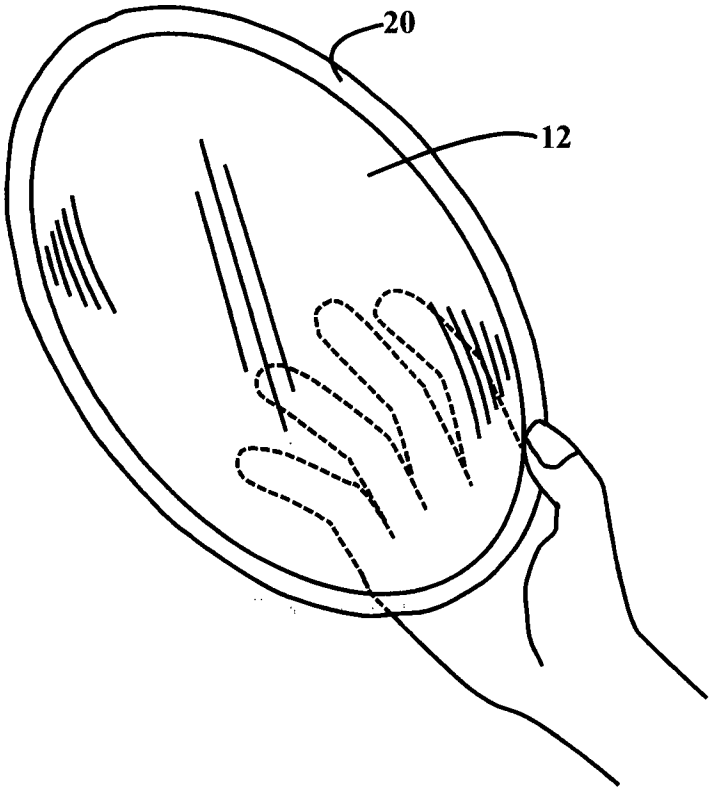
FIG. 2 is a illustration of the means for holding the mirror comprising a rim provided on the perimeter of the mirror.
Figure 5:
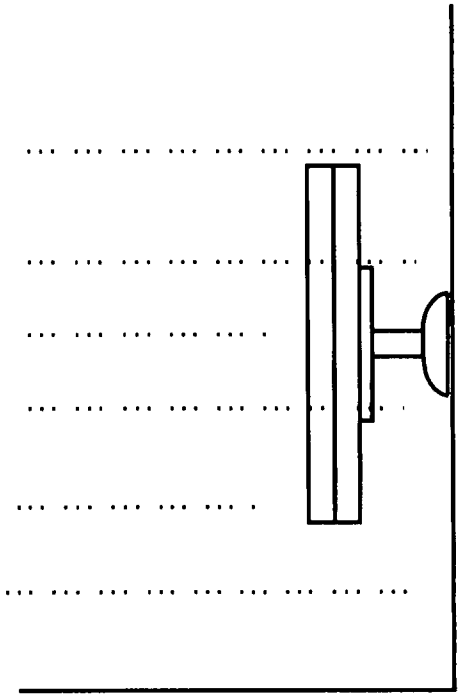
FIG. 5 is an illustration of the mirror mounted underwater to the side of pool.

The present invention relates to a handheld mirror 10 used in and around swimming pools, and in particular in the swim instruction of infants, toddlers and small children, and methods related to swim instruction incorporating the use of the mirror 10. The mirror 10 has a front reflective surface 12 in which a person, in most instances an infant, toddler or small child, can see itself, and back opaque surface 14.

The mirror 10 is constructed from a layer of transparent material 16 and a layer of reflective material 18 affixed to the layer of transparent material 16. The layer of reflective material 18 may be sheet like material adhesively affixed to the layer of transparent material 16 or it may be a layer of reflective paint that adheres to the layer of reflective material 16. A wide variety of reflective materials, and means of affixing them to the layer of transparent material 16, are possible and are specifically contemplated by the principles of the present invention. Similarly, the nature, thickness and properties of the layer of transparent material 16 may vary, and the use of acrylic and plastics is specifically contemplated, although other materials may be used without departing from the principles of the present invention, as long as the limitations set forth in more detail are complied with. Specifically, because the mirror 10 is used in and around a swimming pool, the materials used for the layer of transparent material 16 and layer of reflective material 18 are safe for use in and around water. They are not glass products, or any similar product that is prone to shatter creating jagged shards that would present a safety risk. The layer of transparent material 16 and layer of reflective material 18 are both constructed from shatterproof materials such as, without limitation, acrylic or plastic.

To provide for a long life for the mirror 10, it is also important that the layer of transparent material 16 and layer of reflective material 18 are constructed from materials that are waterproof, i.e. materials that do not react with, absorb or retain water, and which do not deteriorate and are not affected by being in and around water for extended periods of time. Also, because the mirror 10 is used in and around swimming pools, which often are surrounded by concrete decks, the layer of transparent material 16 and layer of reflective material 18 are constructed from materials that are scuff and scratch resistant so that laying the mirror 10 down on the concrete, with either the reflective surface 12 down or the opaque surface 14 down will not result in scuffs or scratches that affect the use of the mirror 10.

The use of the mirror 10 in and around chlorinated swimming pools necessitates the use of materials for the layer of transparent material 16 and layer of reflective material 18 that are non-reactive with chlorine.

One use of the handheld mirror 10, set forth in more detail herein, is as a handheld mirror used in swim instruction of infants, toddlers and small children. To accommodate such use, a means for holding the mirror 10 with one hand is provided. In a first embodiment, a rim 20 is affixed to the perimeter of the mirror 10 and provides the means for holding the mirror 10 with one hand. In a second embodiment, a handle 22 extends from the back surface 14 of the layer of reflective material 18, which handle 22 is easily engaged, grasped and manipulated by an adult size hand. In general, the means for holding comprises a device affixed to the front, side or rear of the mirror 10 which allows an instructor to manipulate, orient and handle with one hand and with minimal effort. By allowing the infant or toddler to see himself while in the water, the psychological comfort level of the infant or toddler is improved. In using the mirror 10 in swim instruction, as set forth in more detail herein, the means for holding is easily engaged with one hand and allows manipulation, reorientation and repositioning of the mirror 10 with one hand.

In a preferred embodiment of the present invention, the mirror 10 further includes a fixation means allowing removable attachment of the mirror 10 to the sides or bottom of a swimming pool. In the most preferred embodiment of the present invention, the fixation means 24 comprises an assembly comprising a first flange 26 affixed to the mirror 10 and a second flange 28 that removably attaches to the side or bottom of a swimming pool. The second flange 28 preferably comprises at least one suction cup 30 which bonds to the sides or bottom of a swimming pool when, as is well known, the suction cup 30 is depressed to purge air from between the suction cup 30 and the surface to which it is attached. It is specifically contemplated that additional suction cups can be added to the mirror 10, as additional attachment means, without departing from the principles of the present invention.

Figure 4:
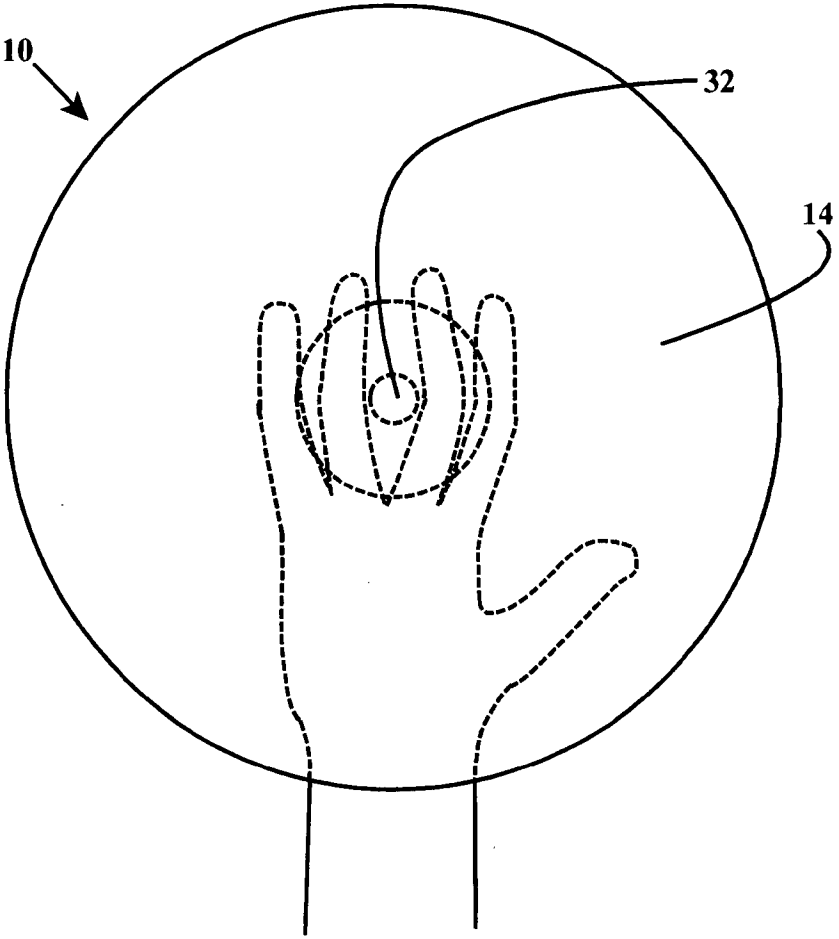
FIG. 4 is an illustration of the hand held mirror having a suction cup acting as a handle, particularly illustrating engagement by a user's hand.

In a preferred embodiment of the present invention, the second flange 28 is affixed to the first flange 26 with at least one transitional stem 32. The transitional stem 32 is sufficiently rigid that, when the second flange 28 is attached to the side or bottom of a swimming pool, the mirror 10 and reflective surface 12 are maintained substantially parallel to the side or bottom surface to which the second flange 28 is attached. Use of additional suction cups would stabilize the attachment to the side or bottom, and are specifically contemplated for that purpose. At the same time the transitional stem 32 is long enough along its length to define a gap 34 between the first flange 26 and second flange 28 that is sufficiently broad for a typical adult hand to be positioned in the gap 34. The transitional stem 32 is also of sufficiently narrow cross-section to fit between typical sized adult fingers. Thus, by mounting the suction cup 30 on the rear side of the mirror 10, a handle is created that can be engaged by an adult hand as shown in FIG. 4 such that the same structure defining the fixation means 24 also defines the means for holding the mirror 10. When utilized as a handle, the transitional stem 32 is positioned between the adult instructor's fingers, with the gap 34 being wide enough for the adult instructor's hand to be positioned therein. The second flange suction cup 30 has a broad enough diameter to span the back of at least two fingers of the adult instructor that is holding the mirror 10. The combination of the width of the second flange suction cup 30 and the narrowness of the transitional stem 32 provide a structural element that is easily and firmly engaged by the instructor's hand by positioning the fingers around the stem 32 and under the suction cup 30.

The principles of the present invention also include methods utilizing the mirror 10 in teaching infants, toddlers and small children to swim in multiple steps or phases including, without limitation, an introductory phase in which infants and toddlers are held by the instructor and acquainted with the water, and subsequent instructional phases in which children are learning to go underwater on their own and to swim down into the water.

Specifically, the mirror 10 is used by an instructor first to make infants more comfortable upon first being introduced to the water by allowing them to see themselves as they are being introduced to the water for the first time. First, a mirror 10 having a reflective surface 12 is provided that is safe for use in and around a swimming pool. The mirror 10 is easily picked up using one hand, having provisions therefor, and is held and manipulated by an instructor using one hand, allowing the instructor to simultaneously pick up and hold an infant or toddler with the other hand during an initial phase of introduction to the water. The instructor then holds, manipulates and orients the mirror 10 so that the infant or toddler can see itself in the mirror as it is being introduced to the water. By allowing the infant or toddler to see himself while in the water, the psychological comfort level of the infant or toddler is improved.

The mirror 10 provided as part of the inventive method of swim instruction is also provided comprising a layer of transparent and layer of reflective material which are waterproof and non-reactive with chlorine. In a critical feature of the invention, the mirror 10 is provided with a handle easily engaged by one hand of the instructor for use during the initial introductory instruction with infants and toddlers. The handle that is provided allows the instructor to re-position and re-orient the reflective surface so that the infant or toddler can continue to see himself, even if the infant or toddler is squirming or restless from the anxiety of being placed in the water.

The mirror 10 utilized in the multi-step swim instruction method is also provided with a means for mounting the mirror 10 underwater to a side or bottom of a swimming pool to provide a motivation and amusement to small children that are just beginning to learn to go underwater to attempt to go underwater and swim down to see themselves in the mirror 10.

It is a significant beneficial feature of the present invention that the handle used by the instructor to manipulate the mirror 10 and the mounting means utilized to position the mirror 10 underwater comprise the same structural elements, in the most preferred embodiment being the suction cup 30 attached to the first flange 26 through the transitional stem 32. The combination of the width of the second flange suction cup 30 and the narrowness of the transitional stem 32 provide a structural element that is easily and firmly engaged by the instructor's hand by positioning the fingers around the stem 32 and under the suction cup 30.

It is also contemplated by the principles of the present invention that the mirror 10, having a mounting device, such as suction cup 30, by which it can be removably attached to a side or bottom of a pool, can be utilized in a method of teaching a small child to swim even in the absence of providing a handle on the mirror 10 or using the mirror 10 in a related introductory swim instruction.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A handheld mirror constructed from non glass products to improve the psychological comfort level of a student used in swim instruction in and around swimming pools comprising:

a layer of transparent material safe for use in and around a swimming pool;

a layer of reflective material affixed to said layer of transparent material safe for use in and around a swimming pool; and means for holding said handheld mirror with one hand above said student comprising a handle, said holding means being safe for use in and around water, and said holding means being shatterproof, fixation means for mounting said handheld mirror to a side or bottom of a swimming pool, said fixation means comprising a first flange affixed to said handheld mirror, a rigid transitional stem and a second flange connected to said rigid transitional stem, said second flange being removably affixed to said side or bottom of said swimming pool, wherein said means for holding and said fixation means both comprise said rigid transitional stem, said rigid transitional stem being sufficiently narrow to be engaged between adult fingers, said rigid transitional stem being sufficiently rigid that said reflective surface is maintained substantially parallel to said side or bottom when affixed thereto, said handheld mirror being alternatively easily manipulated, oriented and handled with said handle when held flat against the palm of an adult hand so that said student can see itself in said handheld mirror, and rigidly attached to maintain a substantially parallel orientation to a side or bottom of a swimming pool when attached thereto.

2. The handheld mirror of claim 1 wherein said mirror comprising a means for holding above said student and said fixation means is waterproof.

3. The handheld mirror of claim 2 safe for use in and around a swimming pool wherein said layer of transparent material and said layer of reflective material are scuff and scratch resistant.

4. The handheld mirror of claim 3 safe for use in and around a swimming pool wherein said mirror comprising said holding means and said fixation means does not react with chlorine.

5. The handheld mirror of claim 4 safe for use in and around a swimming pool wherein said means for holding and said fixation means comprise the same structural elements.

6. The handheld mirror of claim 5 safe for use in and around a swimming pool wherein said holding means is easily engaged with one hand allowing manipulation and changes to orientation and position with one hand.

7. The handheld mirror of claim 6 wherein said second flange comprises a suction cup.

8. The handheld mirror of claim 7 wherein said rigid, transitional stem defines a gap between said first flange and said second flange, said gap being sufficiently broad for a typical adult hand to be positioned therein under said suction cup.

9. The handheld mirror of claim 8 wherein said rigid, transitional stem is narrow allowing typical adult fingers to engage said stem.

10. A method for teaching a small child to swim in multiple phases by improving the psychological comfort level of the child, said method comprising the steps of:

providing a handheld reflective surface that is safe for use in and around a swimming pool and easily picked up by a combination handle, fixation means, held and manipulated with one hand flat against the back of the reflective surface;

picking up and holding the small child with a first hand during an initial phase of instruction;

picking up and holding the reflective surface with a second hand during said initial phase of instruction;

holding, manipulating and orienting the reflective surface such that the small child can see itself in the reflective surface as it is being introduced to the water.

11. The method set forth in claim 10 wherein said step of providing a handheld reflective surface further comprises providing a handheld mirror that is safe for use in and around a swimming pool and that further comprises a handle easily engaged by the first hand.

12. The method as set forth in claim 11 further comprising the steps of:

providing a reflective surface that is waterproof and non-reactive with chlorine, further comprising means for mounting said reflective surface underwater to a side or bottom of a swimming pool;

mounting said reflective surface underwater to a side or bottom of a swimming pool; and using said reflective surface mounted underwater as an amusement for small children to encourage small children to go underwater to see themselves in a subsequent phase of instruction.

13. The method as set forth in claim 12 wherein said providing a reflective surface step further comprises said handle and said mounting means comprising the same structural elements.

14. The method as set forth in claim 13 wherein said handle and said mounting means comprise a first flange permanently affixed to a back side of said non-reflective surface and a second flange comprising a handle affixed to said first flange.

15. A method for teaching a small child to swim in multiple phases comprising the steps of:

providing a reflective surface constructed from non glass products and safe for use in and around a swimming pool, said reflective surface having means for holding an manipulation with one hand to allow a small child to be picked up with the other hand during a first phase of instruction, said reflective surface further having means for mounting to a side or bottom of said swimming pool wherein said means for holding and manipulation and said means for mounting comprise the same structural elements;

manipulating and orienting said reflective surface so that said small child can see himself while in the water to improve the psychological comfort level of the child during said first phase;

mounting said reflective surface to a side or bottom of a swimming pool during a phase of instruction subsequent to said first phase; and said reflective surface mounted underwater providing an amusement and motivation during said phase of instruction subsequent to said first phase for small children learning to swim to encourage said small children to go under water to see their reflections in the mirror.

* * * * *